United States Patent [19]

Cook

[11] Patent Number: 4,503,792

[45] Date of Patent: Mar. 12, 1985

[54] PIVOTABLE MOTOR WITH MOUNTING PIN

[75] Inventor: Albert N. Cook, Madison, N.J.

[73] Assignee: The Singer Company, Stamford, Conn.

[21] Appl. No.: 530,911

[22] Filed: Sep. 9, 1983

[51] Int. Cl.[3] ..... D05B 69/00

[52] U.S. Cl. ..... 112/220; 474/114; 248/635; 248/656; 248/665; 248/666

[58] Field of Search ..... 112/220; 474/114, 133, 474/135; 248/634, 635, 610, 665, 666, 656

[56] References Cited

U.S. PATENT DOCUMENTS

| | | | |
|---|---|---|---|
| 1,253,795 | 1/1918 | Diehl . | |
| 1,370,006 | 3/1921 | Cook . | |
| 1,383,602 | 7/1921 | Corning . | |
| 1,506,440 | 8/1924 | Norris . | |
| 3,253,563 | 5/1966 | Myers | 112/220 X |
| 3,739,735 | 6/1973 | Herron et al. | 112/220 |
| 3,777,685 | 12/1973 | Baruffa | 112/220 |
| 3,955,518 | 5/1976 | Giocolano | 112/220 X |
| 4,240,368 | 12/1980 | Adams | 112/220 |
| 4,350,104 | 9/1982 | Cook | 474/135 |

*Primary Examiner*—James A. Leppink
*Assistant Examiner*—Frank H. McKenzie, Jr.
*Attorney, Agent, or Firm*—William V. Ebs; Robert E. Smith; Edward L. Bell

[57] ABSTRACT

A sewing machine motor is provided with an elongate pin which is affixed in the end portions of the arms of sheet metal motor end brackets, and which is pivotally mounted in frame affixed resilient end blocks to enable the motor to be adjusted about the axis of the pin for the purpose of altering tension in a belt driven by the motor.

6 Claims, 3 Drawing Figures

PIVOTABLE MOTOR WITH MOUNTING PIN

BACKGROUND OF THE INVENTION

1. Field of the Invention

The invention relates to mounting arrangements for electric motors in sewing machines.

2. Description of the Prior Art

It is well known in the sewing machine art to pivotally mount a motor in the frame of a sewing machine, and to provide means for moving the motor about its pivotal axis to adjust the tension in a power transmitting belt driven by the motor. Such an arrangement may be seen, for example, in U.S. Pat. No. 3,379,537 of William L. Herron for "Electric Motor Mount for Sewing Machines", issued June 19, 1973, and U.S. Pat. No. 4,240,368, of Kenneth D. Adams, for "Motorized Drive for a Sewing Machine Including Belt Tensioning Means", issued Dec. 23, 1980.

My U.S. Pat. No. 4,350,104 for "Sewing Machine Motor Mount", issued Sept. 21, 1982 is directed to a particularly inexpensive construction for use in mounting a motor in a machine in a manner enabling the motor to be moved about a pivotal axis for the purpose of adjusting tension in a belt which is driven off the motor shaft. The present invention is directed to an improved version of the patented construction and has a prime object providing such construction with superior impact resisting and vibration isolating characteristics as well as simplified belt tension adjusting mechanism.

Other objects and advantages of the invention will become apparent during a reading of the specification taken in connection with the accompanying drawings.

SUMMARY OF THE INVENTION

In accordance with the invention, an electric motor for use in driving a sewing machine is provided with end brackets which are bolted together and form a fixed part of the motor structure. The end brackets are sheet metal parts formed with arms which extend parallel to each other and include pin receiving end portions. An elongate pin is held in the end portions of the arms so as to extend therebetween in a direction parallel to the motor shaft. Opposite end portions of the pin extending beyond the end portions of the arms are supported in resilient blocks which are affixed in the frame of the machine with clamps that are secured to depending bosses in said frame and caused to forcibly engage the blocks. One of the end brackets includes a tab with an opening through which a rectangular nut on a frame affixed stud may pass when in selected positions. The nut includes a circular flanged portion to bear downwardly against the tab as the nut is turned on the stud and pivot the motor about the axis of the pin to adjust tension in a power transmission belt drivable by the motor.

DESCRIPTION OF THE PREFERRED EMBODIMENT

Figure 1:
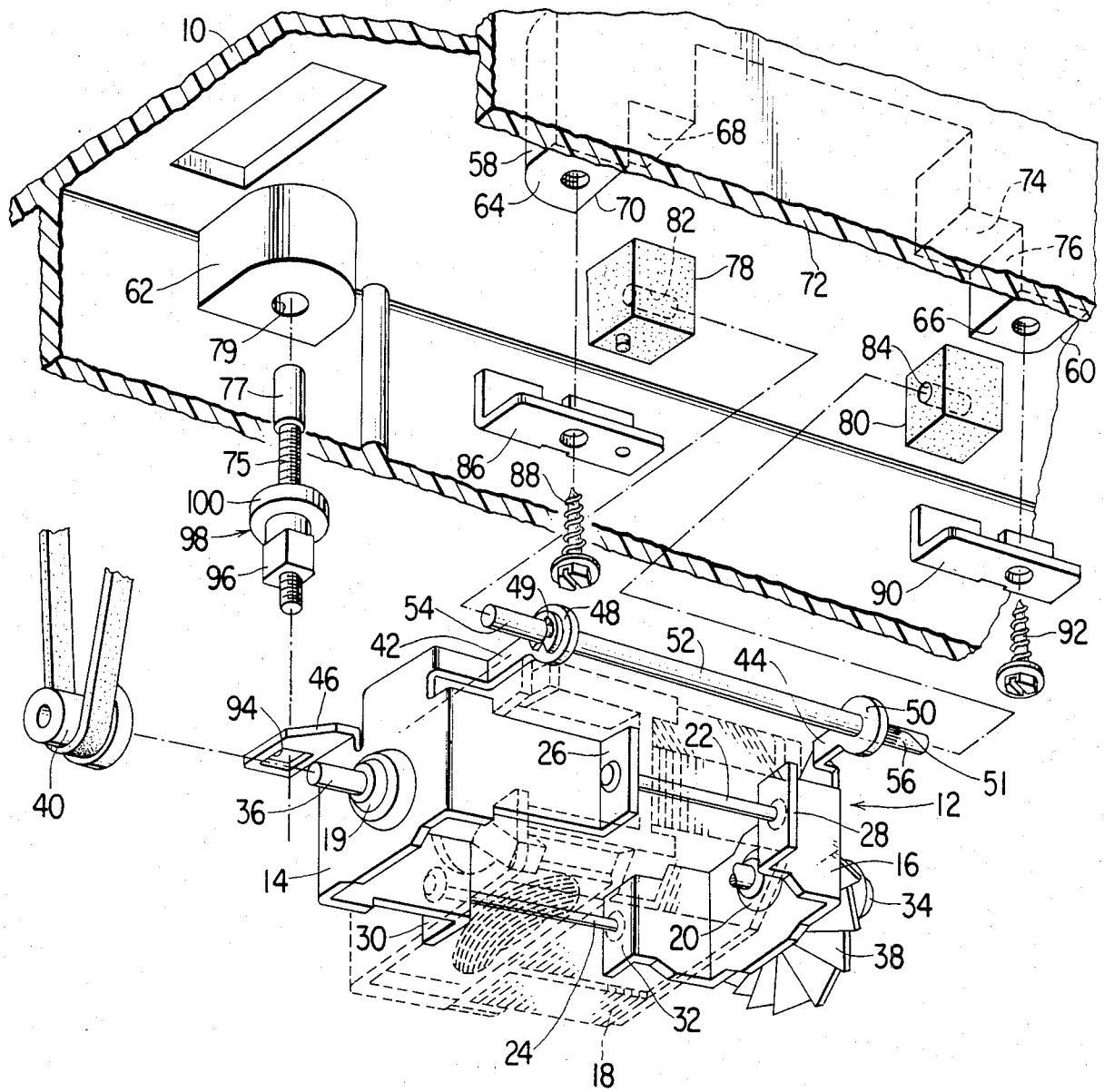
FIG. 1 is a fragmentary bottom partially disassembled perspective view showing the motor mounting arrangement of the invention.
Figure 2:
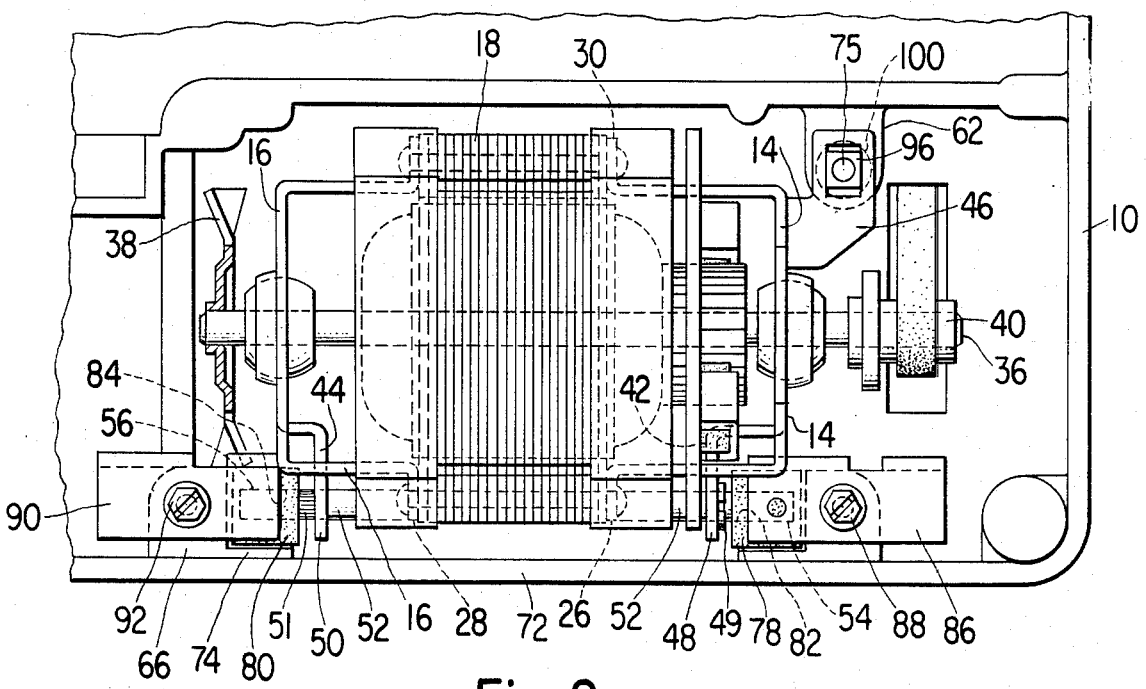
FIG. 2 is a fragmentary bottom view showing the motor mounting arrangement.
Figure 3:
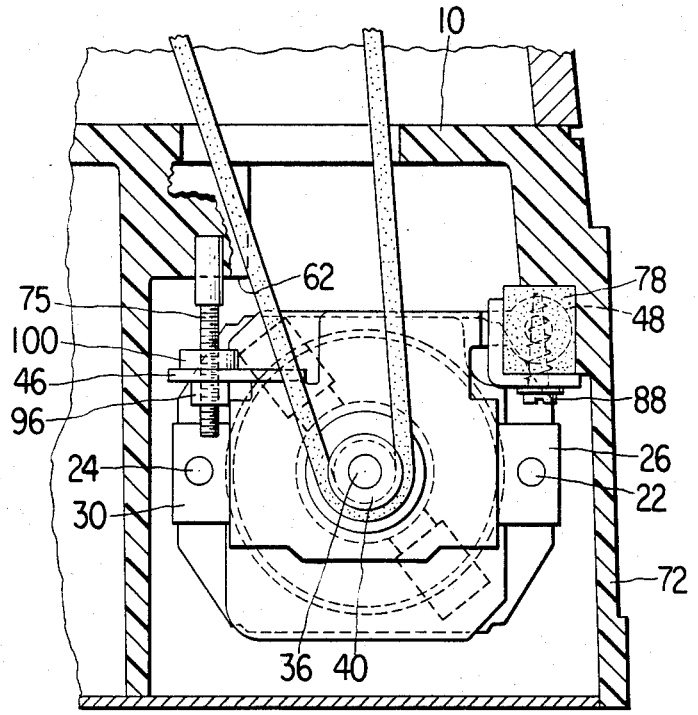
FIG. 3 is an end view of the motor mounting arrangement shown partially in section.

Referring to the drawings, reference character 10 designates the frame of a sewing machine wherein a motor 12 may be supported as described herein. The motor includes stamped out sheet metal end brackets 14 and 16 which are clamped against the stator 18 with rivets 22 and 24 extending through the stator 18 and through flanges formed on the brackets. As shown, rivet 22 extends through flanges 26 and 28 on end brackets 14 and 16, and rivet 24 extends through flanges 30 and 32 on the said end brackets 14 and 16. Brackets 14 and 16 carry bearings 19 and 20, respectively. Bearings 20 and 19 support rotor shaft portions 34 and 36 as indicated. Rotor shaft portion 34 has a fan 38 fixedly mounted thereon, and rotor portion 36 has a pulley 40 secured thereto.

Brackets 14 and 16 are formed with arms 42 and 44 which extend parallel to each other on the motor. One bracket 14 is also formed with a tab 46 which serves a purpose hereinafter described. Arm 42 is formed with a pin supporting end portion 48, and arm 44 is formed with a corresponding end portion 50. An elongated pin 52 is received in holes in the bracket arm end portions 48 and 50. The pin is located in arm end portions 48 and 50, as in the manner shown, with a resilient E-ring 49 thereon adjacent end portion 48 and a knurled formation 51 on the pin adjacent end portion 50. Alternatively, the pin may be staked at the arm end portions or cemented thereto with an adhesive such as epoxy cement. The pin extends through the bracket arm ends in a direction parallel to the motor shaft, and opposite end portions 54 and 56 project beyond the bracket arms.

Sewing machine frame 10 is preferably molded or cast as a unitary structure with depending bosses 58, 60 and 62. Bosses 58 and 60 terminate in bottom end faces 64 and 66, respectively. Boss 58 is formed with a horizontal planar surface 68, and a vertical planar surface 70 which intersect a wall 72 of frame 10. Boss 60 similarly includes a horizontal planar surface 74 and a vertical planar surface 76 which intersect wall 72. A threaded stud 75 is force fitted at one end 77 in a hole 79 in boss 62 into boss 62.

Reference characters 78 and 80 designate resilient blocks. The blocks are formed with blind holes 82 and 84, respectively. Before motor 12 is mounted in machine frame 10, end portion 54 of pin 52 is inserted in hole 82 in block 78, and end portion 56 of the pin is inserted in hole 84 in block 80. The motor is then mounted in the frame by first positioning the resilient blocks 78 and 80 such that block 78 is against planar faces 68 and 78 of boss 58 and wall 72 of frame 10, and block 80 is against faces 74 and 76 of boss 60 and wall 72. A right angled clamp 86 is secured to boss 58 on end face 64 with a screw 88, and a right angled clamp 90 is secured to boss 60 on end face 66 with a screw 92. The clamps 86 and 90 are caused to bear against blocks 78 and 80, respectively at a bottom and side surface thereon, and a fixed position is thereby determined for the blocks in frame 10.

Tab 46 on motor bracket 14 is formed with a rectangular opening 94 which is slightly greater in width and length than a rectangular portion 96 of a nut 98 that is threaded onto stud 75. When motor 12 is mounted in frame 10, nut 98 is turned on stud 79 to align rectangular portion 96 of the nut with opening 94 for passage therethrough. The rectangular portion 96 of the nut is permitted to pass through opening 94, and the nut is then turned to a position wherein rectangular portion 96 interfers with tab 46. Nut 98 includes, in addition to portion 96, a circular flanged portion 100 with a diameter which is greater than the width of rectangular opening 94. Tension in a power transmission belt provided on pulley 40 and operably connected with mechanism of the sewing machine is adjusted by turning nut 98 to cause flanged portion 100 to bear against tab 46 with a selected degree of force, the adjustment being accomplished with pivotal movement of the motor about the axis of pin 52 during which the opposite end portions of the pin may turn in holes 82 and 84 in resilient blocks 78 and 80. Nut 98 is most readily adjusted with a socket wrench which has been positioned over the rectangular portion 96 of the nut.

Impact forces occassioned by the machine being dropped, and noise or vibration in the machine resulting from the operation of motor 12 are more effectively reduced with the motor mounting arrangement of the present invention than with the arrangement of the aforesaid U.S. Pat. No. 4,350,104, both because of the stabilizing effect on bracket arms 42 and 44 of fixed pin 52, and the dampening effectiveness of the massive resilient blocks 78 and 80 wherein the end portions 54 and 56 of pin 52 are mounted. The mounting arrangement of the present invention has also eliminated the need for a biasing spring in the belt tension adjusting mechanism.

Other forms of the invention than those described herein are also possible, and it is to be understood that the embodiments disclosed herein are in no way to be construed as a limitation of the invention. Numerous alterations and modifications of the disclosed structures will suggest themselves to those skilled in the art and all such alterations and modifications which do not depart from the spirit and scope of the invention are intended to be within the scope of the appended claims.

I claim:

1. In a sewing machine, an electric motor including sheet metal end brackets with integral parallel arms; a frame extending over the motor including a pair of depending bosses; an elongate pin extending between and supported in end portions of the parallel arms on the end brackets, the pin extending parallel to the motor shaft and including opposite end portions which project beyond the end portions of said parallel arms; a resilient block wherein one of the end portions of the pin is supported; another resilient block wherein the other end portion of the pin is supported; clamps secured to said bosses and in enforced engagement with the resilient blocks for affixing the blocks in the frame; a power transmission belt in the machine drivable by the motor; and means for pivoting the motor about the axis of said pin to effect a tension adjustment in the belt.

2. The combination of claim 1 wherein the pin is located in holes in the arm end portions with a resilient ring on the pin adjacent one end portion and a knurled formation on the pin adjacent the other end portion.

3. The combination of claim 1 wherein the pin is staked against each of end portions of the bracket arms.

4. The combination of claim 1 wherein the pin is secured with an adhesive to each of the end portions of the bracket arms.

5. The combination of claim 1 wherein the means for pivoting the motor about the axis of said pin to effect a tension adjustment in the belt includes a threaded stud which is secured in the frame, and a nut which is adjustable on the stud and has a flange in engagement with a tab on one of the end brackets at a location apart from the axis of the pin.

6. The combination of claim 5 wherein the nut includes a rectangular portion which extends through a rectangular opening in said tab, and the flange engages the tab on the opposite side from the rectangular portion of the nut.

* * * * *